US005224517A

United States Patent [19]

Veith et al.

[11] Patent Number: 5,224,517

[45] Date of Patent: Jul. 6, 1993

[54] LOOM CLOTH BEAM CHANGER WITH LOOP FORMING WEDGE FOR INCOMING CLOTH

[75] Inventors: Günther Veith, Münsingen-Dottingen, Fed. Rep. of Germany; Tonny Raaijmakers, Winterthur, Switzerland

[73] Assignee: Sulzer Brothers Limited, Winterthur, Switzerland

[21] Appl. No.: 643,789

[22] Filed: Jan. 22, 1991

[30] Foreign Application Priority Data

Jan. 24, 1990 [CH] Switzerland ..... 223/90-5

[51] Int. Cl.[5] ..... D03D 49/00

[52] U.S. Cl. ..... 139/1 R; 139/291 R; 242/66

[58] Field of Search ..... 242/56 R, 66, 58.1, 242/59; 139/291 R, 1 R

[56] References Cited

U.S. PATENT DOCUMENTS 3,493,187 2/1970 Gottschalk .
4,000,863 1/1977 Straujaps .
4,606,381 8/1986 Suwa et al. .
4,892,119 1/1990 Hugo et al. ..... 139/1 R
4,910,837 3/1990 Fujimoto et al. ..... 139/1 R
5,022,439 6/1991 Yano et al. ..... 139/1 R

FOREIGN PATENT DOCUMENTS 0296113 12/1988 European Pat. Off. .
0296114 12/1988 European Pat. Off. .

*Primary Examiner*—Andrew M. Falik
*Attorney, Agent, or Firm*—Kenyon & Kenyon

[57] ABSTRACT

A transporter has transfer elements for moving an empty cloth beam into a position between a loom and a transporter or into a winding station of the loom. In addition, the transporter carries a curved wedge for engaging against the positioned empty cloth beam so as to hold a length of cloth between the full cloth beam on the transporter and the wedge. A cutting device serves to cut the cloth between the two beams. In one embodiment, the wedge moves about the cloth beam to form and insert a loop of cloth in a pressing zone formed by the cloth beam and the incoming cloth. In a second embodiment, the cloth beam carries resilient elements to form a pressing zone and is rotated relative to a stationary wedge in order to insert a loop of cloth between the resilient elements and the surface of the empty cloth beam.

26 Claims, 4 Drawing Sheets

LOOM CLOTH BEAM CHANGER WITH LOOP FORMING WEDGE FOR INCOMING CLOTH

This invention relates to a cloth beam changer for a loom and a method of changing cloth beams in a loom.

As is known, various types of arrangements have been provided for the exchanging of cloth beams in a loom. For example, EPA 0 296 114 and 0 296 113 describe various types of transporters which receive a full cloth beam from a loom in exchange for an empty cloth beam. U.S. Pat. No. 4,606,381 describes another type of apparatus for automatically exchanging cloth rollers in a loom.

Still further, it has been known from Belgium patent 1000684 A-4 to cut a length of cloth extending between an empty cloth beam in a loom and a full cloth beam on a transporter and to use a wedge for entrainment of the severed cloth to the empty cloth beam. As described, the wedge has a double contour of the cloth beam and a beam contacting roller while adhesive strips are provided to act as winding start elements on the empty cloth beam. For reliable entrainment of the severed cloth, the adhesion provided by adhesive strips is necessary; however, this feature not only requires this strip to be applied but also introduces an additional factor in that the adhesive effect depends upon storage time, ambient temperature and humidity and the nature of the woven fabric.

Accordingly, it is an object of the invention to simplify the securement of a cloth end to an empty cloth beam supplied from a transporter to a loom.

It is of object the invention to insure a reliable winding start of a new cloth beam in a loom or in a space adjacent the loom.

Briefly, the invention is directed to a loom having a winding station for rotatably receiving an empty cloth beam for winding of a cloth thereon and a movable transporter having means for receiving a full cloth beam from the loom, means for receiving an empty cloth beam, transfer elements for transferring the empty cloth beam to the loom and a cutting device for cutting across a cloth extending between an empty cloth beam and the means receiving the full cloth beam.

In accordance with the invention, a wedge is provided which has a curved surface for pressing against a layer of cloth on the empty cloth beam. This wedge and the empty cloth beam are also movable relative to each other in order to form a loop in the cloth for tucking-in under subsequent windings of the cloth on the beam.

In one embodiment, the wedge is a curved wedge which is movable about the empty cloth beam to tuck a loop of cloth into a pressing zone between the empty cloth beam and the incoming cloth in order to secure the loop to the empty cloth beam for subsequent winding of the incoming cloth thereon.

In another embodiment, the empty cloth beam is provided with at least one pressing element in order to define a pressing zone therebetween. In this embodiment, the wedge is movable into the pressing zone in order to tuck a loop of cloth between the pressing element and the cloth beam in response to rotation of the cloth beam relative to the wedge. In this embodiment, after the wedge has inserted the loop into the pressing zone, the cloth beam can be rotated in an opposite direction in order to extract the wedge from the pressing zone while at the same time leaving the loop in the pressing zone for subsequent overlaying of the cloth thereon.

In both embodiments, a drag element, such as a roller, may be connected to the wedge for pressing a cloth onto the empty cloth beam during movement of the wedge about the empty cloth beam.

These and other objects and advantages of the invention will become more apparent from the following detailed description taken in conjunction with the accompanying drawings wherein.

Figure 1:
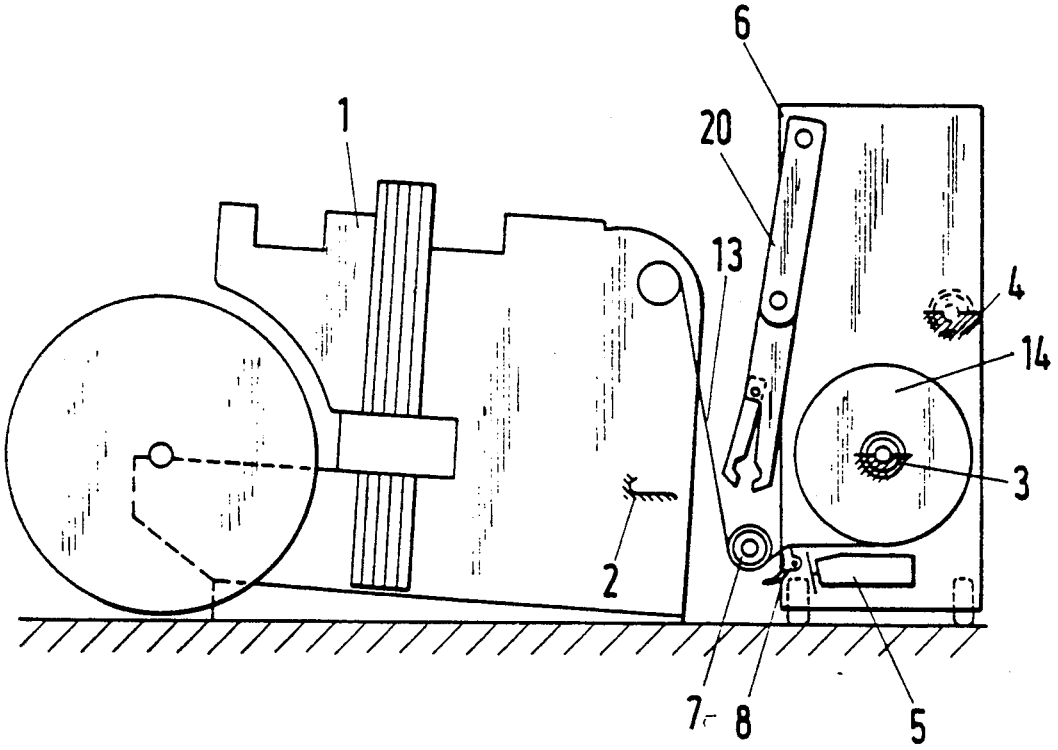
FIG. 1 illustrates a diagrammatic view in longitudinal section of a loom and transporter constructed in accordance with the invention.

Referring to FIG. 1, the loom 1 is of conventional construction and includes a winding station 2 for rotatably receiving an empty cloth beam for winding a cloth 13 thereof. In addition, a movable transporter is provided to act as a cloth beam changer for replacing a full cloth beam with an empty cloth beam. As indicated, the transporter has support means 3 for receiving a full cloth beam 14 from the loom and second means 4 for receiving an empty cloth beam. In addition, the transporter 6 has transfer elements 20 for transferring an empty cloth beam 7 from the support means 4 into a space between the loom 1 and transporter 6 or into the winding station 2, i.e. into the path of the cloth 13. The transporter 6 also has a cutting device 5 for cutting the cloth 13 extending between the empty cloth beam 7 and the full cloth beam 14 supported on the support means 3.

As illustrated, the transporter 6 is also provided with a curved wedge 8 adjacent the cutting device 5. This wedge 8 is more particularly illustrated in FIGS. 5 to 7.

Figure 5:
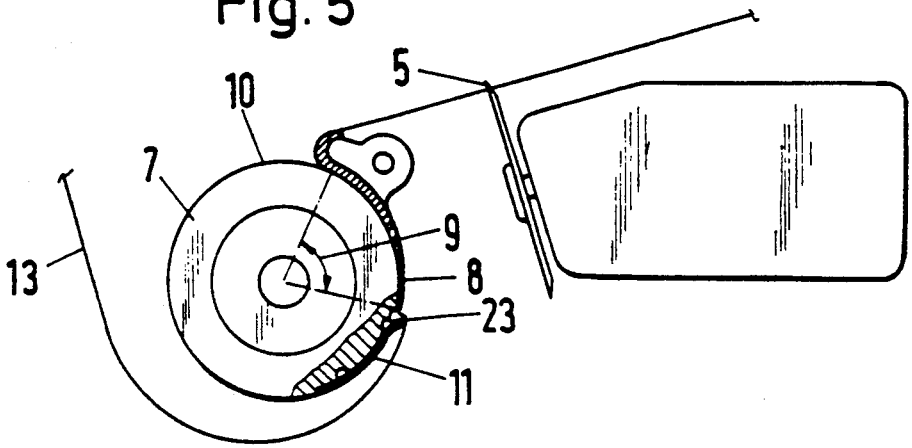
FIG. 5 illustrates a modified wedge which cooperates with a pressing element on an empty cloth beam to tuck-in a loop of cloth in accordance with the invention.

Referring to FIG. 5, wherein like reference characters indicate like parts as above, the wedge 8 is provided with a curved surface which is sized in accordance with the surface 10 of the empty cloth beam 7 so as to press the cloth 13 therebetween. As indicated, the beam 7 is rotatable in opposite directions as indicated by the double arrow 9 via suitable drive elements in the transfer elements so as to rotate relative to the wedge 8 which is shown in a stationary position.

As indicated in FIG. 5, the empty cloth beam 7 has at least one pressing element and preferably a plurality of pressing elements each in the form of a resilient spring strip 11 which is secured at one end to the cloth beam 7 in order to define a pressing zone therebetween. In addition, each strip 11 has a free end 23 which defines a conical entry with the cloth beam 7 in order to receive the wedge 8 therebetween. Further, the cloth beam 7 has a recess 17 (see FIG. 6) of concave shape to receive the free end of the strip 11 under pressure of subsequent cloth winding layers thereon.

During the exchange of beams, the empty beam 7 may be placed in the winding position 2 of the loom 1 or within the space between the loom 1 and transporter 6 as illustrated in FIGS. 1 and 5. In the latter case, the beam 7 is brought into contact with the wedge 8 with the cloth 13 extending to the full cloth beam 14 mounted in the transporter 6.

The transfer elements 20 (see FIG. 1) are used to press the empty beam 7 onto the wedge 8 which is operative in the opposite direction to the arrival direction of the incoming cloth. Upon being pressed against the wedge 8 which is stationary, the cloth 13 extending between the two beams 7, 14 is prestressed by a drive for the means 3 for supporting the full cloth beam 14 in the transporter 6. During severance, the incoming cloth 13 which continues to be supplied by the loom sags in an arc relative to the empty beam 7.

Figure 6:
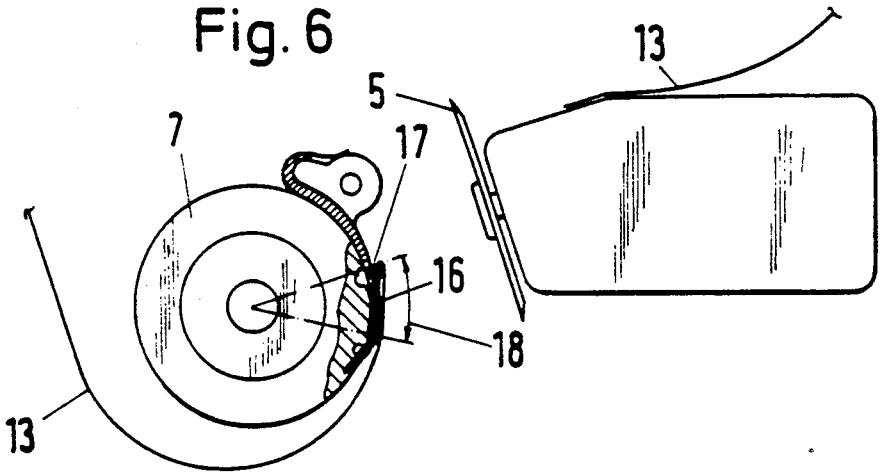
FIG. 6 illustrates a view similar to FIG. 5 with the wedge within the pressing zone defined by the pressing element in accordance with the invention.

Referring to FIG. 6, after cutting of the cloth 13, the empty cloth roll 7 is rotated in a counter-clockwise direction as viewed so that the wedge 8 forms a loop in the cloth 13 which is then tucked into the pressing zone 16 between the pressing elements 11 and the surface 10 of the cloth beam 7. As indicated, the pressing zone 16 extends over a predetermined angle 18 which is sufficient to permit a reliable securement of the cloth loop in the zone 16.

The transfer elements 20 are provided with drive means, as is known, for rotating the empty cloth beam 7 while engaged therein. This drive means serves to rotate the empty beam 7 in the direction of the incoming cloth so that the wedge 8 moves into the pressing zone 16 as indicated in FIG. 6. Thereafter, the empty beam 7 is rotated in the opposite direction until the wedge 8 releases from the pressing zone 11. At this time, the spring strips 16 retain the loop 12 of cloth while pressing the loop 12 onto the cloth beam 7.

Figure 7:
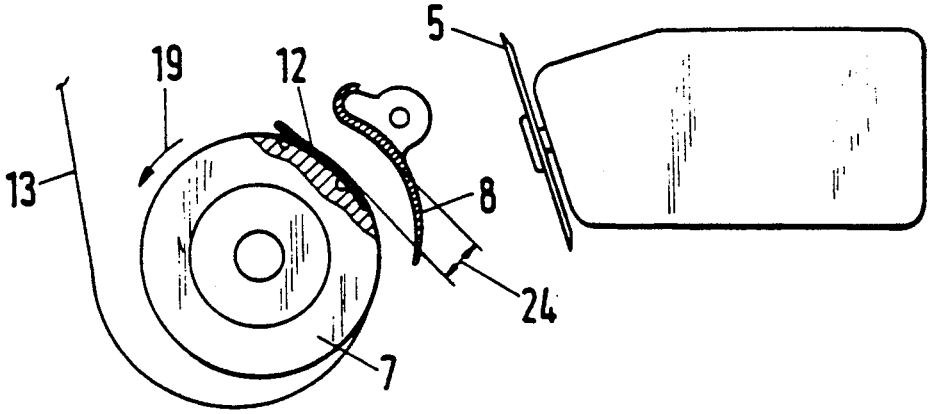
FIG. 7 illustrates a view similar to FIG. 5 after tucking in of a loop of cloth under the pressing element of the cloth beam.

Referring to FIG. 7, the distance between the beam 7 and wedge 8 is then increased by a suitable distance 24 such that the beam 7 can rotate in the incoming direction of the cloth without tensioning the incoming cloth 13 until at least the spring strips 16 have been covered by the arriving cloth 13. The beam 7 continues to rotate at the incoming cloth speed and with a torque limited by a slipping clutch (not shown). The cloth 13 is thus secured on the beam 7 by the spring strips 11 and by the retaining effect of more than one winding layer of cloth.

The rotation for the start of the winding of the sagging cloth 13 can be produced by the drive of the transfer elements 20 and by the drive at the winding station 2 if the distance 24 is, at the start, sufficient for the transfer elements to introduce the beam 7 into the winding station 2 before any cloth has been wound fast on the beam 7.

After the started empty beam 7 has taken over the winding at the winding station 2 of the loom, the transfer elements 20 are free to pivot back into the transporter 6. The transporter 6 then disconnects from the loom 1 and is displaced in order to deliver the full beam 14 and to supply an empty beam for subsequent use.

Figure 2:
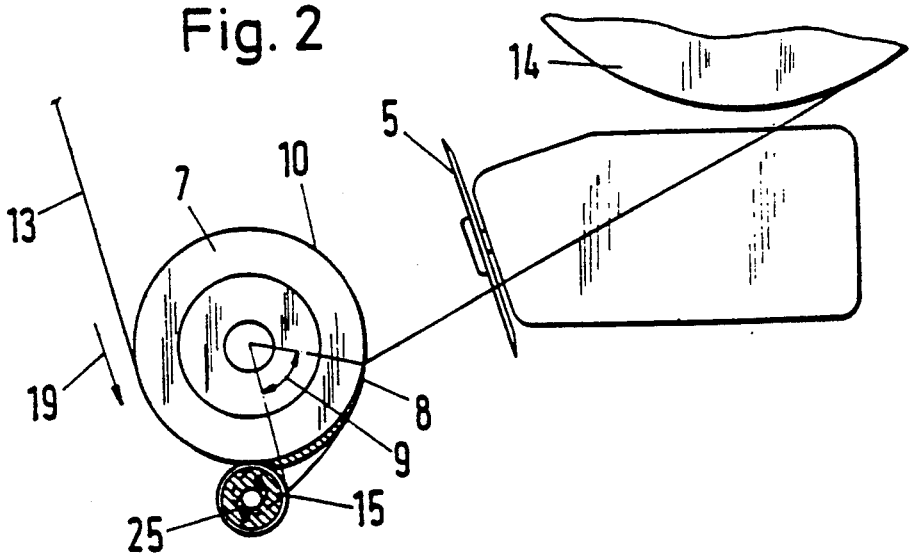
FIG. 2 illustrates a diagrammatic view of a wedge which is movable about an axis of an empty cloth beam and a cutting device for cutting the cloth between the empty cloth beam and full cloth beam.
Figure 3:
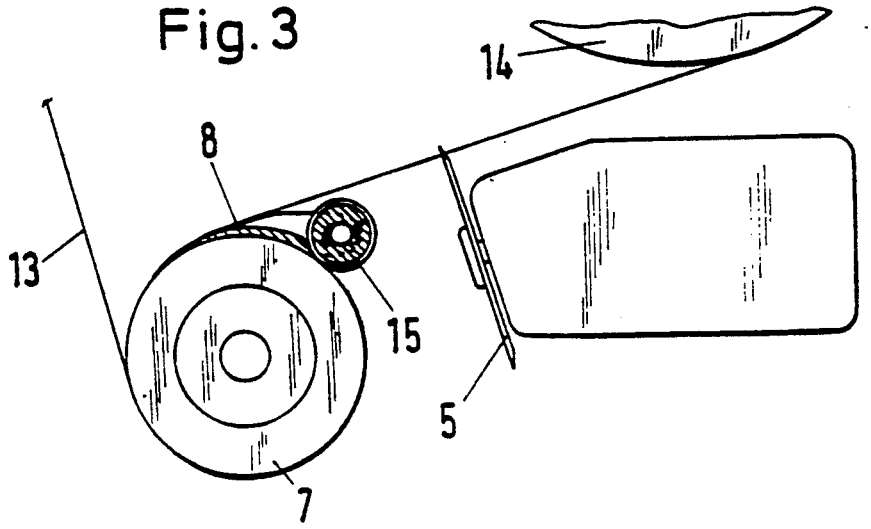
FIG. 3 illustrates a view similar to FIG. 2 with the wedge in a position to prestress the cloth for cutting.
Figure 4:
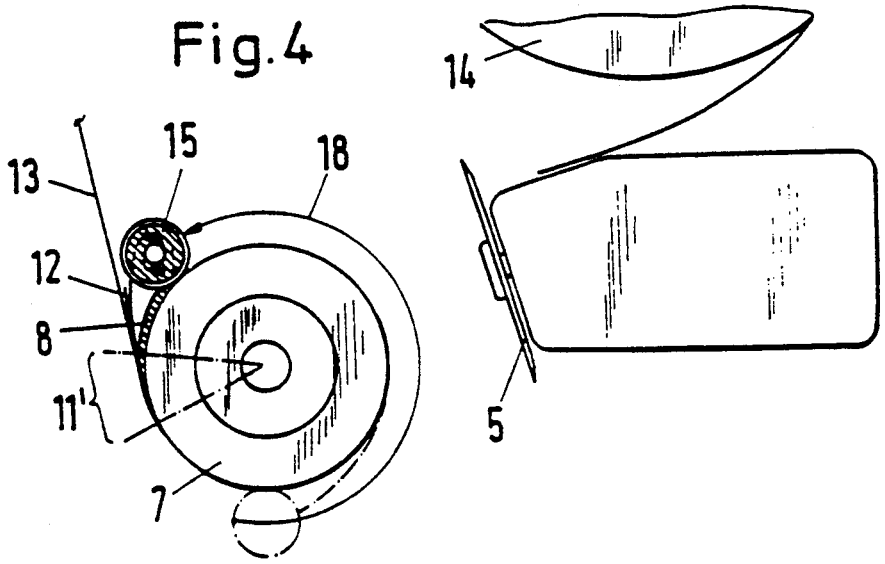
FIG. 4 illustrates a view similar to FIG. 2 of the wedge in a tuck-in position in accordance with the invention.

Referring to FIGS. 2 to 4, wherein like reference characters indicate like parts above, the wedge 8 can be constructed to move circumferentially around a circumferential portion of the empty cloth beam 7 and about the axis of the empty cloth beam 7. In this case, the wedge 8 is a curved plate having one side in engagement over a predetermined determined angle 9 with the envelope surface 10 of the empty cloth beam 7. In this embodiment, as a result of a relative rotation of the wedge 8 about the empty beam 7, for example over an angle of about 135°, a loop of cloth is formed about the wedge 8 as indicated in FIG. 3. At the same time, the cloth 13 is tensioned between the end of the wedge 8 and the full cloth beam 14 so that the cutting device 5 is able to cut the cloth therebetween. After cutting of the cloth 13 by the cutting device 5, the wedge 8 is further moved about axis of the cloth beam 7 so that the resulting cloth loop 12 is tucked into a pressing zone 11, between the empty cloth beam 7 and the incoming cloth 13 such that the loop 12 becomes secured to the empty cloth beam 7 for subsequent winding of the incoming cloth 13 thereon. As indicated, the wedge 8 moves over a relatively large angle 18 relative to the empty cloth beam 7 into the pressing zone, 11, (see FIG. 4).

After the cloth loop 12 has been tucked in, the wedge 8 can be extracted from the pressing zone 11, and rotated back to the initial condition and/or moved away from the cloth beam 7.

Referring to FIG. 1, the full cloth beam 14 which is mounted on the support means 3 of the transporter 6 continues to rotate in the winding-on direction with a torque limited by a slipping clutch (not shown) while the transfer elements 20 transfer an empty cloth beam 7 from the support means 4 into a predetermined position relative to the wedge 8. The wedge 8 is disposed so that the cloth 13 which is preloaded with an adjustable torque by the support means 3 crosses the cutting path of the cutting device 5 which is disposed outside the cloth 13.

The cloth 13 is preferably severed by the cutting device 5 transversely to the direction of movement and while being preloaded or biased. The cloth end associated with the full beam 14 is completely wound thereon while the new cloth start arising as a result of the cut is pushed as indicated in FIGS. 5.2 to 4 in the form of a loop 12 or as indicated in FIGS. 5 to 7 via an intermediate loop 12 by the wedge 8 into the pressing zone 11 to engage the empty cloth beam.

As shown in FIGS. 2 to 4, a drag element 15 in the form of a roller is secured to the wedge 8 for pressing the cloth 13 onto the empty cloth beam 7. As indicated in FIGS. 2 and 3, the wedge 8 and/or drag roller 15 presses the cloth 13 onto the empty beam 7 and rotates in the incoming direction 19 through an angle 18 around the axis of the empty beam 7. In this respect, the roller 15 has an adjustable torque for entraining the cloth in the incoming direction. When, as shown in FIG. 3, the cutting position has reached, the arriving cloth 13 is biased into engagement with the beam 7 by way of the roller 15 and the friction arising from the cloth looping around the beam 7. The preloading or biasing is produced by a rotating drive having a slipping clutch in the support means 3 for receiving the full cloth beam. As the wedge 8 and roller 15 rotate further, the cloth 15 remains preloaded or biased on the wedge 8 with the cloth loop 12 moving into the pressing zone 11.

Where passing rollers 15 are provided, as the wedge 8 moves back, the rollers 15 roll on the beam 7 with radial preloading but, because of a free wheel 25 (see FIG. 2) do not produce entraining torque directed opposite to the incoming cloth direction 19.

During the insertion of the empty beam 7 and the subsequent winding and insertions steps, the transfer elements 20 assist departure by an adjustable rotation at the places receiving the empty beam 7, the rotation being limited by a predetermined slipping torque. During the rotation of the wedge 8 in the arrival direction, a positive ideal for severance is reached when a cloth 13 starts to engage with the outer rounding of the wedge 8. Thereafter, its suffices if rotation continues at a speed corresponding to approximately half the cloth arrival speed in order to stop the cloth for a predetermined time between the full beam and the empty beam so that a cut can be made substantially transversely to the cloth without interrupting the incoming movement of the cloth on the empty beam. The cloth end present as a result of severance wound on the full beam 14 by means of the rotating drive of the support means 3.

Referring to FIG. 4, during the rotation of the wedge 8 through about the cloth beam 7 over the angle 18, the empty beam 7 is driven by the transfer elements 20 (see FIG. 1) to rotate about its own axis at the cloth arrival speed. When the cloth loop 12 is inserted in the pressing zone 11, the loop 12 is transferred immediately, i.e. the speed of insertion of the wedge 8 is less than the cloth arrival speed. The cloth is then wound over the loop 12 to a predetermined angle by the drive for the transfer elements 20 before the elements 20 transfer the started beam 7 to the loom winding station 2.

Figure 8:
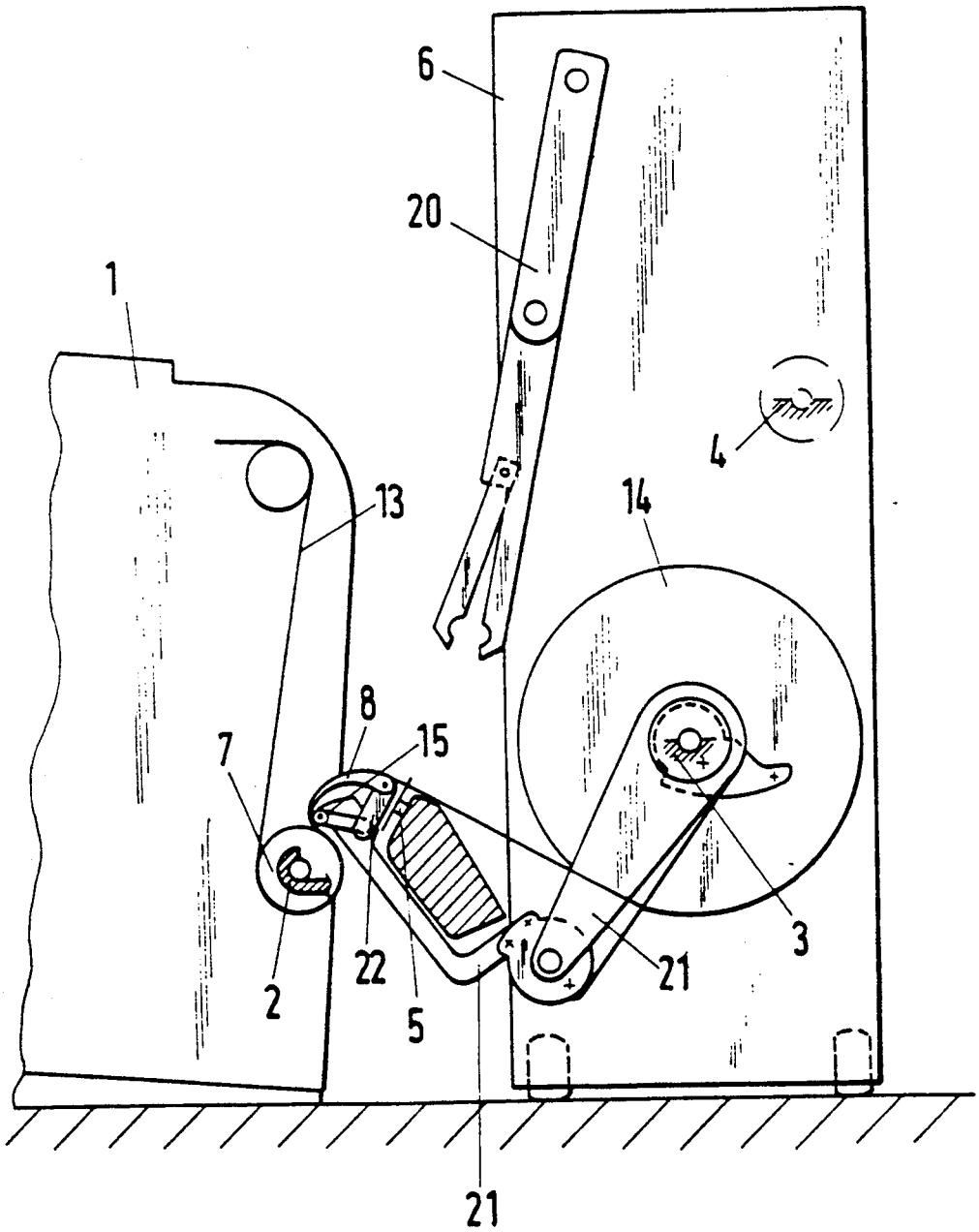
FIG. 8 illustrates a diagrammatic view of a further embodiment of a wedge mounted on a swing arm of a transporter in accordance with the invention.

Referring to FIG. 8, wherein like reference characters indicate like parts above, the empty cloth beam 7 may be introduced into the loom winding station 2 without an intermediate stop. In this case, the wedge 8 and rollers 15 are guided into a position astride the winding station 2 by way of a swing arm 21 which is pivotally mounted on the transporter 6. As indicated, the cutting device 5 and wedge 8 are both mounted on the swing arm 21. In this embodiment, the winding station 2 of the loom serves to drive the empty cloth beam 7 right from the start.

The pressure applied by the rollers 15 in association with the free wheel (not shown) limits the speed of rotation of the beam 7 to the cloth arrival speed. In order to locate the cut not to close to the loom 1 yet not to produce excessive pieces of waste, the wedge 8 is pivoted onto the empty beam 7 only after the pressing rollers 15 have been engaged with the beam 7 by means of double pivoted levers 22 in order to stop the cloth smoothly during cutting, then to tuck the cloth loop in along the periphery of the beams 7.

As illustrated in FIG. 8, the cloth 13 after passing about the empty cloth beam 7 passes over the surface of the wedge 8 and extends to the full cloth beam 14 on the support means 3 in the transporter 6. After cutting by the cutting device 5, the wedge 8 moves in counterclockwise manner about the axis of the beam 7 in order to tuck the resulting loop of cloth into a pressing zone between the beam 7 and the incoming cloth 13, for example in a manner as described above with respect to FIG. 4.

The use of movingly connected rigid elements enables the start of winding to be performed with a high reproducibility rate and in a manner which can be automated in a profitable manner.

The serviceability of the curved inserting wedge 8 can be enhanced by a smooth surface so that the friction which occurs between the wedge surface and the inserted cloth when the wedge 8 is withdrawn from the pressing zone is only slight.

The invention thus provides a relatively simple technique for starting the winding of a fresh cloth end on an empty cloth beam in a loom after a beam exchange has taken place.

What is claimed is:

1. In combination,

A loom having a winding station for rotatably receiving an empty cloth beam for winding of a cloth thereon;

a movable transporter having first means for receiving a full cloth beam from said loom, second means for receiving an empty cloth beam, transfer elements for transferring an empty cloth beam from said second means to said winding station, and a cutting device for cutting a cloth extending between an empty cloth beam and a full cloth beam in said first means to form a forward end on the cloth extending from said loom; and a curved wedge for engaging a layer of cloth on said empty cloth beam while forming the forward end of the cloth extending therefrom into a loop, said wedge being movable around a circumferential portion of the empty cloth beam to tuck said loop of cloth into a pressing zone between the empty cloth beam and the incoming cloth to secure said loop to the empty cloth beam for subsequent winding of the incoming cloth thereon.

2. The combination as set forth in claim 1 wherein said wedge has a smooth low friction surface facing the empty cloth beam.

3. The combination as set forth in claim 1 wherein said wedge is a curved plate having a surface for pressing against a cloth on the empty cloth beam.

4. The combination as set forth in claim 3 which further comprises a drag element connected to said wedge for pressing a cloth onto the empty cloth beam during movement of said wedge about said empty cloth beam.

5. The combination as set forth in claim 1 which further comprises a drag element connected to said wedge for pressing a cloth onto the empty cloth beam during movement of said wedge about said empty cloth beam.

6. The combination as set forth in claim 5 wherein said wedge and drag element are movable in direction away from said pressing zone after tucking-in a said loop.

7. The combination as set forth in claim 1 which further comprises a swing arm movably mounted on said transporter with said wedge mounted thereon.

8. The combination as set forth in claim 7 which further comprises double pivoted levers secured to and between said swing arm and said wedge for articulating said wedge on said swing arm.

9. The combination as set forth in claim 7 wherein said cutting device is mounted on said swing arm.

10. In combination a loom having a winding station for rotatably receiving an empty cloth beam for winding of a cloth thereon;

a movable transporter having first means for receiving a full cloth beam from said loom, second means receiving an empty cloth beam having at least one pressing element thereon to define a pressing zone between said element and said empty cloth beam, transfer elements for transferring said empty cloth beam to said winding station, and a cutting device for cutting a cloth extending between an empty cloth beam and said first means; and a curved wedge for engaging a layer of cloth on said empty cloth beam, said wedge being movable circumferentially of said empty cloth beam into said pressing zone to tuck a loop of the cloth between said pressing element and said empty cloth beam upon rotation of said empty cloth beam relative to said wedge.

11. The combination as set forth in claim 10 wherein said wedge has a smooth low friction surface facing the empty cloth beam.

12. The combination as set forth in claim 10 wherein said wedge is a curved plate having a surface of mating shape to the empty cloth beam.

13. The combination as set forth in claim 10 which further comprises a drag element connected to said wedge for pressing a cloth onto the empty cloth beam.

14. The combination as set forth in claim 10 wherein said pressing element is a resilient spring strip secured at one end to said cloth beam.

15. The combination as set forth in claim 14 wherein said strip has a free end defining a conical entry with said cloth beam to receive said wedge therein.

16. The combination as set forth in claim 15 wherein said cloth beam has a recess of concave shape to receive said free end of said strip therein under pressure of subsequent cloth winding layers thereon.

17. In combination, a loom having a winding station for rotatably receiving an empty cloth beam for winding of a cloth thereon;

a movable transporter having means for receiving a full cloth beam from said winding position of said loom and a cutting device for cutting across a cloth extending between an empty cloth beam in the path of the cloth and a full cloth beam in said means to form a forward end on the cloth extending from the empty cloth beam; and a wedge having a curved surface for pressing against a layer of cloth on an empty cloth beam, said wedge and the empty cloth beam being movable circumferentially relative to each other to form a loop in the cloth for tucking-in under subsequent windings of the cloth on the beam.

18. The combination as set forth in claim 17 which further comprises a drag element connected to said wedge for pressing a cloth onto the empty cloth beam.

19. The combination as set forth in claim 17 which further comprises an empty cloth beam having at least one pressing element thereon to define a pressing zone for receiving said wedge and cloth loop therebetween.

20. The combination as set forth in claim 19 wherein said wedge is stationary relative to said beam for tucking said loop of cloth into said pressing zone.

21. A method of changing cloth beams in a loom comprising the steps of moving a full cloth beam from a winding station in a loom onto a movable transporter;

moving an empty cloth beam from the movable transporter into the path of the cloth to position a length of cloth between said beams;

pressing the cloth against said empty cloth beam over a predetermined angle of said empty cloth beam, wherein the predetermined angle is sufficient to secure the cloth against the empty cloth beam;

cutting the cloth extending between said beams to form a free forward end on the cloth extending from the loom;

thereafter forming a loop in the cloth for subsequent tucking-in of the loop under subsequent windings of the cloth on the empty cloth beam; and moving the loop of cloth about the axis of the empty cloth beam to tuck said loop into a circumferential pressing zone between the empty cloth beam and an incoming cloth to secure said loop therebetween for subsequent winding of the incoming cloth thereon, wherein said circumferential pressing zone extends over an angle of more than 10° C.

22. A method as set forth in claim 21 which further comprises the steps of pressing the layer of cloth against said empty cloth beam under a variable tension in the incoming cloth while tucking said loop of cloth into said circumferential pressing zone.

23. A method as set forth in claim 21 wherein the cloth extending between said beams is prestressed prior to said step of cutting.

24. A method of changing cloth beams in a loom comprising the steps of moving a full cloth beam from a winding station in a loom onto a movable transporter;

moving an empty cloth beam from the movable transporter into the path of the cloth to position a length of cloth between said beams;

pressing the cloth against said empty cloth beam over a predetermined angle of said empty cloth beam;

cutting the cloth extending between said beams to form a free forward end on the cloth extending from the loom;

thereafter forming a loop in the cloth for subsequent tucking-in of the loop under subsequent windings of the cloth on the empty cloth beam;

rotating the empty cloth beam in a first direction to tuck said loop of cloth into a pressing zone on the cloth beam; and thereafter rotating the empty cloth beam in an opposite direction for subsequent winding of an incoming cloth thereon.

25. A method as set forth in claim 24 wherein said cloth beam is rotated in said winding station with a variable torque to limit the tuck-in forces and, wherein said cloth beam is rotated at a variable speed to stretch out a loose incoming cloth.

26. A method as set forth in claim 24 wherein the cloth is held stationary between said beams during said step of cutting before being tucked in for obtaining a cut which is parallel to an axis of the full cloth beam.

* * * * *

UNITED STATES PATENT AND TRADEMARK OFFICE

CERTIFICATE OF CORRECTION

PATENT NO. : 5,224,517

DATED : July 6, 1993

INVENTOR(S) : Veith et al.

It is certified that error appears in the above-identified patent and that said Letters Patent is hereby corrected as shown below:

Column 1, line 33, change "of object" to --an object of--;

Column 4, lines 15, 21 and 23, change "11" to --11'--;
line 42, change "5.2" to --2--;
line 55, change "has" to --is--;

Column 5, line 7, change "positive" to --position--;
line 9, change "its" to --it--;
line 16, after "severance" insert --is--;
line 43, change "to close" to --too close--.

Signed and Sealed this

Twenty-first Day of June, 1994

*Attest:*

Bruce Lehman

BRUCE LEHMAN

*Attesting Officer*

*Commissioner of Patents and Trademarks*